United States Patent [19]

Tucker

[11] 4,192,066

[45] Mar. 11, 1980

[54] ANTI-RAPE DEVICE

[76] Inventor: Willkie Y. Tucker, 3513 S. Crochan, Los Angeles, Calif. 90016

[21] Appl. No.: 892,117

[22] Filed: Mar. 31, 1978

[51] Int. Cl.[2] ..... B26B 5/00

[52] U.S. Cl. ..... 30/162

[58] Field of Search ..... 43/6, 5; 135/78, 79, 135/80, 81; 30/162, 164.7, 151, 286, 162

[56] References Cited

U.S. PATENT DOCUMENTS

| | | | |
|---|---|---|---|
| 1,181,681 | 5/1916 | Nicaud | 30/151 |
| 2,512,237 | 6/1950 | Mravik | 30/151 |
| 2,741,025 | 4/1956 | Stewart | 30/164.7 X |
| 3,895,441 | 7/1975 | Horak | 30/162 |
| 4,002,366 | 1/1977 | Hammes | 30/162 |
| 4,043,067 | 8/1977 | Konucik | 43/6 |

*Primary Examiner*—Jimmy C. Peters

*Attorney, Agent, or Firm*—Louis J. Bachand

[57] ABSTRACT

An anti-rape defensive weapon is provided comprising a barbed shank similar to a fish-hook barb carried in a barrel like hand grip arranged to expose the barbed shank when the device is pressed against the flesh of an assailant. A particular feature provides for the separation of the shank lodged in the assailant.

8 Claims, 4 Drawing Figures

ANTI-RAPE DEVICE

BACKGROUND OF THE INVENTION

This invention has to do with the defensive weapons for person safety and more particularly is concerned with an anti-rape device which is useful in warding off assailants such as rapists and others without use of lethal means.

A rising tide of personal assaults ranging from armed and unarmed robbery through muggings and rapes have necessitated the development of personal defense means. While some espouse weaponless defense based upon strength and agility as well as certain martial arts tactics, most persons are unwilling to engage in hand-to-hand combat with a person who is not only generally physically larger and stronger, but also one who may be dangerous when provoked as can occur in a personal battle. The carrying of weapons is banned in many cities and states particularly those weapons which are concealable and which are immediately useful for warding off attackers. Further, a response by the attack victim in excess of that necessary to ward off the attack may result in legal charges being brought against the victim, as where a lethal weapon such as a gun or knife is used.

Accordingly, the problem is to provide simple portable failsafe weaponry which can be carried on the body or in the hand at the ready in a dangerous situation such as a nearly empty parking lot and which at the same time is not illegal to carry because it does not meet the definitions of a lethal weapon.

It is desirable that such a device be inexpensive, reliable in operation, not lethal to the attacker, and if possible, leave an identifying mark upon the attacker for facilitating arrest and subsequent prosecution and conviction.

SUMMARY OF THE INVENTION

It is accordingly a major objective of the invention to provide a personal defensive device which is effective in warding off potential rapists and other potential assailants which is non-lethal, easily concealed upon the person, failsafe in operation, provided with means to leave a tell-tale sign upon the attacker and which causes immediate excruciating pain which precludes angry response which could conceivably place the victim in even greater danger than his or her original danger.

This and other objects of the invention to become apparent hereinafter are realized in accordance with the present invention in a personal defensive device which comprises a shank having a barbed point, a hand grippable barrel coaxially mounting the shank in point-forward thrusting relation and coaxial hood means covering the point against unintentional use and displaceably responsive to barrel thrusting of the device against an assailant to lodge the shank point in the assailant. Typically, the shank is a straight, rigid, metal bar element, which may be separable from the device in assailant lodged relation to provide a tell-tale; the hood may be telescopically partially within the barrel; there may be provided a shank extension coupled to the barrel in shank driving relation. In more preferred embodiments there is provided a spring, centered on the shank extension and biasing the hood into shank point covering position, the shank and shank extension each comprising straight, rigid, metal bar elements, slip-jointed together whereby the shank and shank extension are separable for lodging of the shank in an assailant, the slip-joint preferably comprising a tube terminally receiving the shank and shank extension in opposed, removable relation.

It will be apparent from the foregoing summary of the invention that there is provided a hand-grippable barrel, which can conform to a fountain pen in its overall dimensions, which has two telescoping sections, one of which comprises a hood generally overlying a barbed shank point (similar to a barbed fish-hook point) and the other section mounting the shank and a shank extension useful for driving the shank whereby thrusting of the device at an assailant will cause the hood to retract and the barrel and enclosed shank extension to drive the straight shank and its barbed point into the assailant.

In the nature of barbed points, after entry the attempted removal of the barb merely causes increased pain and necessitates removal of substantial amounts of flesh, unlike a knife, assuring in many instances that the assailant will be unable to remove the device without doctor supervised surgery and thus the assailant will be more easily found. Further, the immediate and intense pain associated with the penetration of the barbed hook into the assailant's body insures that the assailant will turn his thought to his own predicament and will be unable or at least uninterested in further molesting of the potential victim.

BRIEF DESCRIPTION OF THE DRAWINGS

The invention will be further described as to an illustrative embodiment in conjunction with the attached drawings in which.

DESCRIPTION OF THE PREFERRED EMBODIMENT

Figure 1:
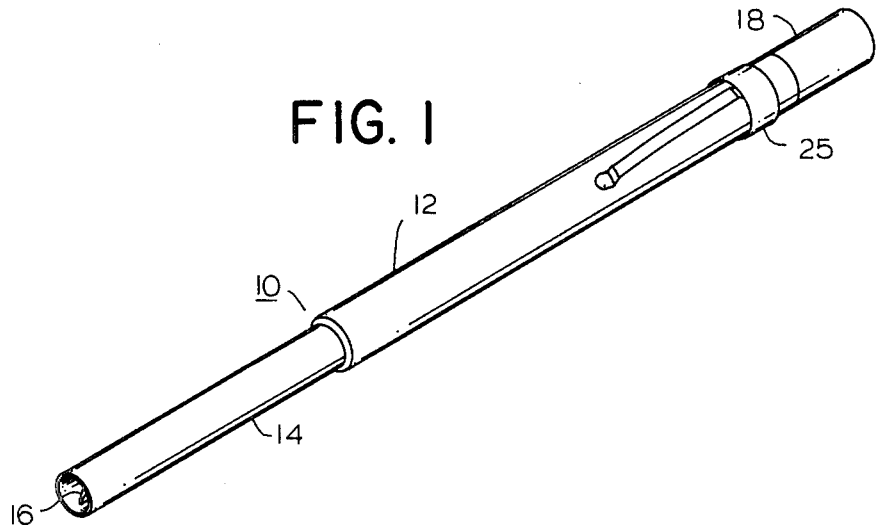
FIG. 1 is a perspective view of the stop-rape device of the present invention.

With reference now to the drawings in detail, in FIG. 1 the device 10 is shown comprising a rearward barrel section 12 sized to be handgrippable, e.g. like a fountain pen or knife handle, and a forward hood section 14 encircling the shank point 16. Barrel section 12 and hood section 14 are suitably formed of thermo-plastic and may be segments of different diameter tubes. A plug 18 closes the rearward end of barrel section 12.

Figure 2:
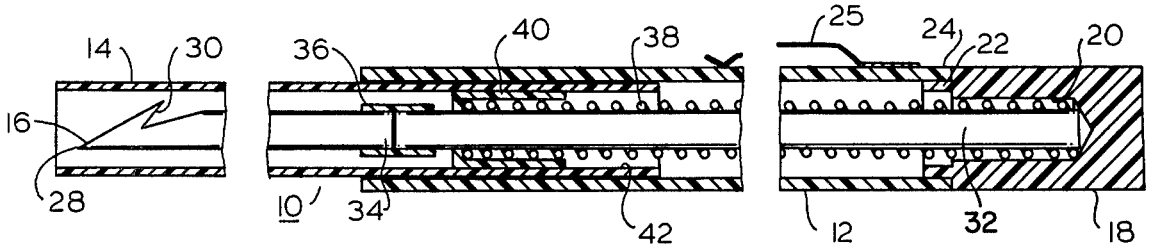
FIG. 2 is a view in vertical section of the device.

Details of construction of the device are shown in FIG. 2. Barrel section 12 carries end plug 18, also suitably formed of thermo-plastic and having an axial bore 20 and a flange ring 22 defining annular shoulder 24 for fixed interfitment with the rearward end of barrel 12. Barrel section 12 carries clip 25.

Hood section 14 is telescopically sized and snugly slidably received in barrel section 12 for extension or retraction relative thereto. On extension, the hood section 14 projects forwardly (left in the drawing) sufficiently to encircle and overlie the shank 26 and its point 28 having barb 30.

Figure 3:
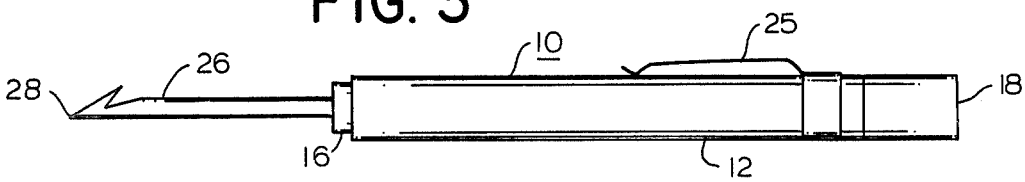
FIG. 3 is a view like FIG. 1 in front elevation showing the hood section retracted and the barbed shank extended as in an assailant penetrating position.
Figure 4:
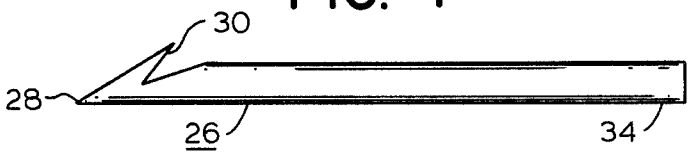
FIG. 4 is a front elevation view of the shank portion of the stop-rape device.

On retraction, hood section 14 exposes the shank 26 and the point 28 and barb 30; see FIG. 3.

A shank extension 32 lies within the barrel section 12 extending along the section 12 axis from the bore 20 of end plug 18 to butt with the inner terminus 34 of shank 26. Sleeve 36 suitably of deformable thermoplastic provides a slip coupling for the opposed ends of the shank 26 and shank extension 32, for purposes of enabling the manual thrusting force exerted on the barrel 12 to be transmitted from end plug 18 through the shank extension 32 into the shank 26, thereby to drive shank point 28 into the body of an assailant.

When the device is not in use, as when being carried in a purse or a pocket, the hood 14 thereof remains in the extended condition under the resilient bias of spring 38 which is compressed between plug 18 and retainer cup 40 fixed to the hood inner periphery 42 as shown.

When used, the device 10 is thrust against the body of the assailant, displacing responsive the hood 14 and exposing for entry into the assailant's body the shank point 28. This position is best shown in FIG. 3. As a further feature of the invention, retraction or withdrawal of the device from the assailant will cause the barbed shank 26 to separate from the device at the slip coupling sleeve 36 thereby leaving a tell-tale shank portion in the body of the assailant. Efforts to remove this shank only aggravate the pain resultant from being thrust with this device.

I claim:

1. Personal defensive device for warding off potential rapists and other potential assailants, said device comprising a shank having a lateral offset defining a barbed point, a hand grippable barrel coaxially mounting said shank separably in point forward thrusting relation, and coaxial hood means covering said point against unintentional use and displaceably responsive to barrel thrusting of the device against an assailant to lodge the shank point in said assailant.

2. Personal defensive device in accordance with claim 1 in which said shank is a straight, rigid, metal bar element.

3. Personal defense device according to claim 1 in which said hood is telescopically mounted partially within said barrel.

4. Personal defensive device according to claim 1 including also a shank extension coupled to said barrel in shank driving relation.

5. Personal defensive device according to claim 4 in which said hood means is telescopically mounted partially within said barrel and including also a spring centered on said shank extension and biasing said hood into shank point covering position.

6. Personal defensive device according to claim 5 in which said shank and shank extension comprise straight, rigid, metal bar elements.

7. Personal defensive device for warding off potential rapists and other potential assailants, said device comprising a shank having a barbed point and a shank extension, a hand grippable barrel coaxially mounting said shank and shank extension in point forward thrusting relation, coaxial hood means covering said point against unintentional use and displaceably responsive to barrel thrusting of the device against an assailant to lodge the shank point in said assailant, said hood means being telescopically mounted partially within said barrel, and a spring centered on said shank extension and biasing said hood into shank point covering position, said shank being slip jointed to said shank extension to be separable in the lodged condition in an assailant.

8. Personal defensive device according to claim 7 including also means defining a slip joint between said shank and shank extension, said slip joint means comprising a tube terminally receiving said shank and shank extension in opposed removable relation.

* * * * *